US006158940A

United States Patent [19]

Nehring

[11] Patent Number: 6,158,940

[45] Date of Patent: Dec. 12, 2000

[54] DEVICE FOR THE BACK ROUNDING OF BOOK BLOCKS

[75] Inventor: Dieter Nehring, Bad Oeynhausen, Germany

[73] Assignee: Kolbus GmbH & Co. KG, Rahden, Germany

[21] Appl. No.: 09/468,149

[22] Filed: Dec. 21, 1999

[30] Foreign Application Priority Data

Dec. 22, 1998 [DE] Germany ..... 198 59 330

[51] Int. Cl.[7] ..... B42B 9/00

[52] U.S. Cl. ..... 412/9; 412/22; 412/24; 412/18; 412/23; 412/25; 412/30; 74/74; 74/109; 74/128; 74/405; 74/422

[58] Field of Search ..... 412/22, 24, 23, 412/18, 30, 25; 74/74, 405, 422, 109, 128

[56] References Cited

U.S. PATENT DOCUMENTS

| | | | |
|---|---|---|---|
| 3,413,669 | 12/1968 | Throp | 11/5 |
| 5,114,293 | 5/1992 | Rathert | 412/30 |
| 5,658,111 | 8/1997 | Rathert | 412/30 |
| 6,024,524 | 2/2000 | Braker et al. | 412/6 |

FOREIGN PATENT DOCUMENTS

| | | |
|---|---|---|
| 04 44 409 B1 | 3/1995 | European Pat. Off. . |
| OS 15 36 507 | 1/1970 | Germany . |
| 43 30 719 A1 | 9/1994 | Germany . |

*Primary Examiner*—Stephen F. Gerrity
*Assistant Examiner*—Daniel Phan
*Attorney, Agent, or Firm*—Alix, Yale & Ristas, LLP

[57] ABSTRACT

A device for the back rounding of book blocks in a book binding machine cooperating with a conveyor device. The device includes a driving arrangement and rounding elements driven in rotation by the driving arrangement. The rounding elements taking up the book block following release of the book block by the conveyor device. The rounding elements acting on both sides of the book block through pressurized rotational movement thereof. When the book blocks are gripped by the rounding elements, the rounding elements may selectively travel in a lifting movement which is separate from the rotational movement into preselectable, defined vertical positions.

39 Claims, 2 Drawing Sheets

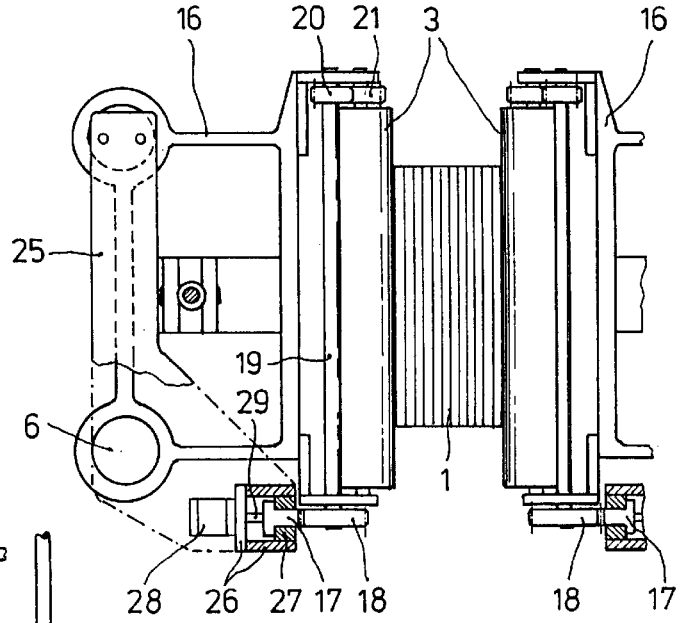
Fig. 2
Fig. 4
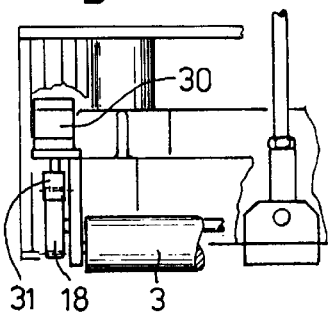
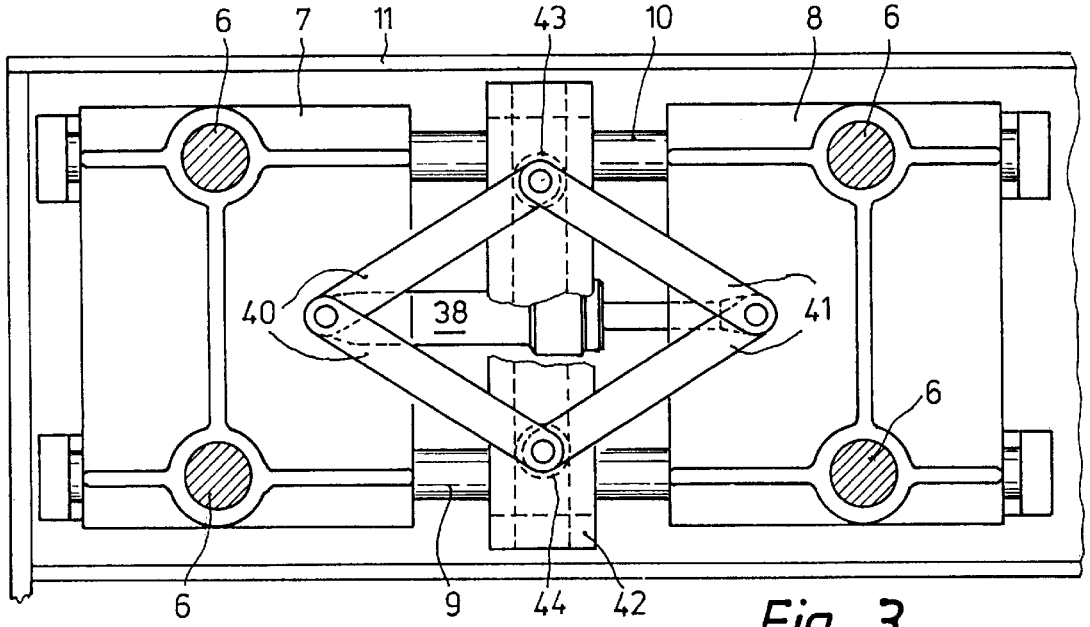
Fig. 3

DEVICE FOR THE BACK ROUNDING OF BOOK BLOCKS

BACKGROUND OF THE INVENTION

1. Field of the Invention

The invention relates to a device for the back rounding of book blocks in a bookbinding machine with a conveyor device for the book blocks and with rounding elements which are driven in rotation by a driving arrangement. More particularly, the invention relates to a device for the back rounding of book blocks which, after taking up the book block and following its release by the conveyor device, act on both sides of the book block through a defined rolling movement and through pressure.

2. Description of Related Art

In industrial book production the back and, at the same time, the front edge of the book block undergo a change in shape in the back rounding process section. This is primarily performed by means of the roller rounding principle in book block processing machines. In this case a smooth relative displacement of the individual leaves or printed sheets takes place through rounding rollers rolling on the book block sides over a defined rotational angle while pressure is simultaneously applied, the leaves or printed sheets being increasingly pushed towards the book block center as the book block passes through the rounding rollers.

The rounding operation forms the book block back as a circular arc or a flattened arc, which is crucial for the subsequent process section of backing the book block back with regard to the desired back profile of the book block.

When employing the back rounding principle through rounding rollers, the shape of the back is influenced by various factors, such as contact force of the rounding rollers, rotational angle of the rounding rollers, and by the diameter of the rounding rollers.

In the backing process section the rounded book block is finally given the desired back shape, which is in accordance with the binding method and is determined by a fold which is provided in the region of the book block near the back and which may be formed either as a deep fold with an angle of up to 90° or as a shallow or oblique fold with an angle of up to 45°. The backing is carried out by a formed piece reciprocating over the entire width of the back, whereby pressure and friction are applied to bend over the folded printed sheets from the center of the book block back to both sides at an angle which increases towards the outside. The book block is thus given its mushroom-like back shape while being stabilized at the same time. In order to carry out the backing operation, the book block is gripped between backing boards with a defined projecting length from the rounding end.

A book rounding and backing machine with rounding rollers rolling on both sides of the book block and with a formed piece acting on the book block back is represented and described as an example in DE-OS 15 36 507.

The folded width between the folded edge and the rounding end is to be adjusted according to the folded forms, this taking place through vertical adjustment of the book block between the backing boards, i.e., through varying the length projecting from the backing boards.

A bookbinding machine for the back rounding of book blocks with rounding rollers which can travel vertically in recesses in a clamping jaw is known from the European Patent Specification 0 444 409 assigned to the assignee hereof. The vertical movement of the rounding rollers is superimposed on the rotational movement so as to compensate for the vertical movement of the book block produced due to the rotational movement. The outer leaves of the book block are held at a constant level. The rounding rollers are located at pivot levers which can travel vertically and move at the sides of the book block, and the rotational movement of the rounding rollers is derived from the vertical movement. The rounding rollers are driven in rotation by the driving arrangement of the pivot levers as a result of a gearwheel of the driving arrangement rolling on a stationary rack through a vertical movement of the pivot levers.

SUMMARY OF THE INVENTION

An object of the invention is to develop a device for the back rounding of book blocks in a book binding machine such that the structural expenditure is significantly reduced and the bookbinding machine can be set up more easily and in less time. Another object is to optimize the back rounding process with regard to the quality of the book blocks.

The device according to the invention for the back rounding of book blocks in a bookbinding machine enables the folded width and the rounding displacement to be adjusted independently of one another through separate movement sequences of the rounding rollers. It is thereby possible, via the lifting movement of the book blocks through the rounding rollers, without a rolling movement, on the one hand to adjust the folded width for the subsequent backing operation and on the other to execute any format-dependent compensating stroke required following intermediate clamping by a transport means, so that there is no need to undertake a vertical adjustment in a subsequent station.

The format-dependent rounding displacements of the rounding rollers can be adjusted with maximum accuracy under computer control via the positioning stroke executed by the working cylinder with the displacement measuring system.

The mechanical positive coupling guarantees an absolutely synchronous movement of the carriages with the rounding rollers to the center of the book blocks, which additionally helps to improve quality. The rounding rollers automatically adjust to the book block thickness through controlling the clamping movement via a hydraulic cylinder, resulting in a reduction in structural expenditure and set-up time owing to the lack of associated adjustment and a constant and adjustable clamping force.

BRIEF DESCRIPTION OF THE DRAWINGS

The invention is explained in detail on the basis of an embodiment represented in the drawings, in which:

FIG. 2 is a sectional view of the device of FIG. 1 taken along lines 2—2 of FIG. 1;

FIG. 3 is a sectional view of the device of FIG. 1 taken along lines 3—3 of FIG. 1; and FIG. 4 is a partial sectional view of a braking appliance for a rounding segment.

DETAILED DESCRIPTION OF THE PREFERRED EMBODIMENTS

Figure 1:
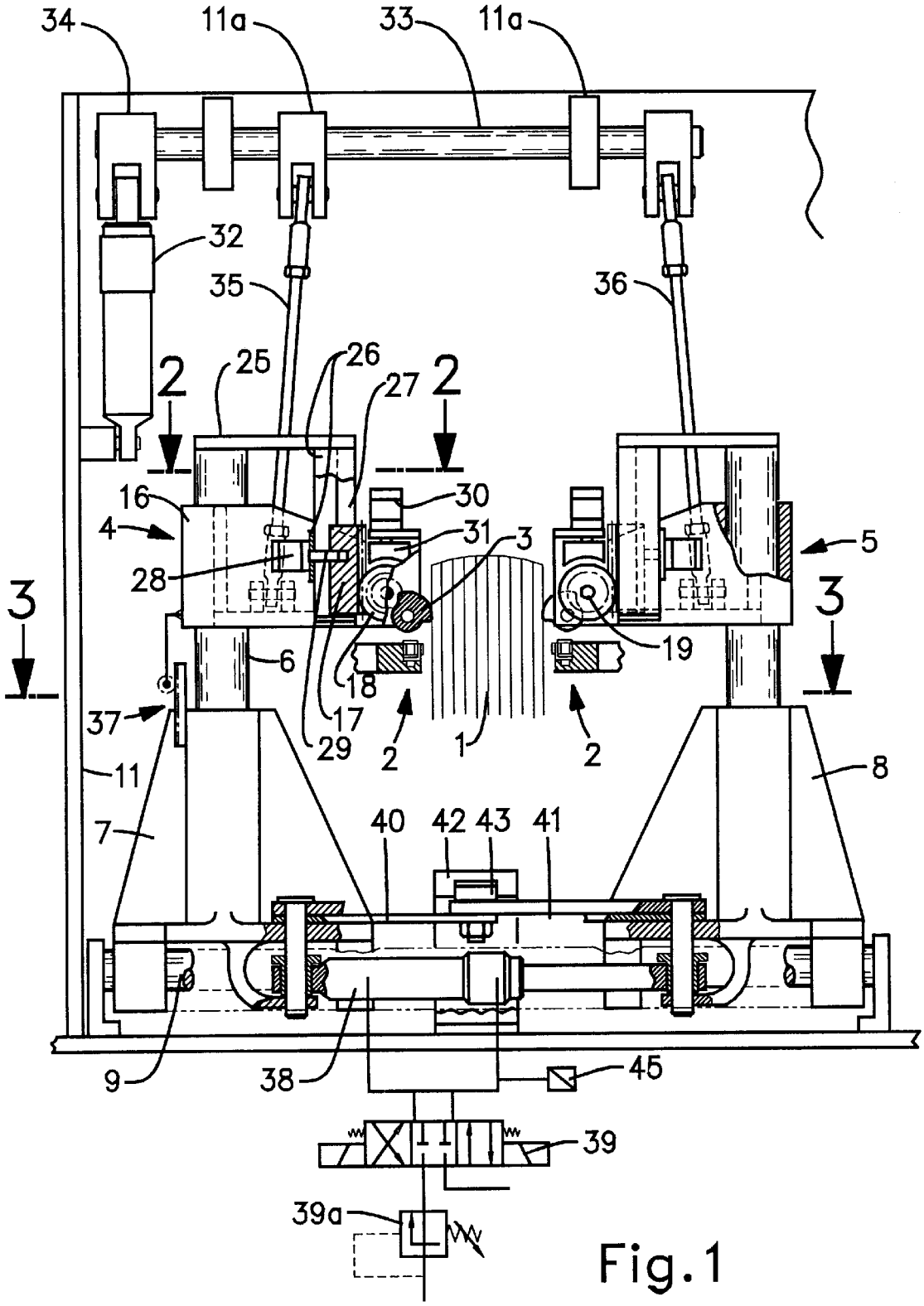
FIG. 1 is a partial front sectional view of a device for the back rounding of book blocks in accordance with an embodiment of the present invention.

The following applications have been filed contemporaneously herewith and each of which are incorporated herein by reference. U.S. Patent Application entitled "A Device For Backing Book Blocks", U.S. application Ser. No. 09/467, 572; U.S. patent application entitled "A Device For Rounding And Backing Book Blocks", U.S. application Ser. No. 09/470,484; U.S. patent application entitled "A Book Production Line", U.S. application Ser. No. 09/470,617.

In accordance with an embodiment of the present invention, book blocks with preformed backs enter a rounding station disposed upstream of a backing station in a book block rounding and backing machine. The book blocks are taken up by rounding elements of a rounding station after the blocks have been released by a conveyor. The rounding elements act on both sides of the book block through a defined rolling movement and through pressure.

Referring now to FIG. 1, the back rounding device according to the invention comprises two rounding heads 4 and 5 with roller-shaped rounding segments 3, which take up the book blocks 1 from a studded chain conveyor 2. The two rounding heads 4 and 5 are located so as to travel vertically on two vertical columns 6 in carriages 7 and 8. The carriages 7 and 8 can be displaced synchronously from the sides towards the center of the studded chain conveyor 2 and are mounted on guides 9 and 10 (see FIG. 3) located on the machine frame 11 as will be described in greater detail below.

Referring now also to FIG. 2, for reasons of simplification the following description refers to just one of the rounding heads 4 and 5 each of which are configured in mirror-image fashion.

The roller-shaped rounding segment 3 is rotatably mounted in a supporting frame 16 of the rounding head 4 which can be displaced along the columns 6. The rounding segment 3 is driven in rotation through the vertical movement of the rounding head 4. In particular, movement of rounding head 4 causes driving gearwheel 18 on a shaft 19 of the supporting frame 1 6 to mesh with a stationary rack 17 and thereby cause movement of an intermediate gearwheel 20 and a driven gearwheel 21 of the rounding segment 3.

The rounding radius of the rounding segments 3 correspond to the pitch diameter of the driving gearwheel 18. The vertical movement of the book block 1 produced as a result of the rotational movement of the rounding segments 3 through the linear movement of the rounding heads 4 and 5 is compensated (as described below), so that the outer leaves or printed sheets of the book block 1 are held accurately at a constant level during the rounding process.

As illustrated in FIG. 2, the rack 17 has a t-shaped profile and is vertically displaceable in guides 27 of a supporting plate 25. The supporting plate 25 is attached to the columns 6 and a guide frame 26 extends vertically downwards therefrom. The rack 17 is fixed in the guide frame 26 via a locking device 29 which is controlled by a working cylinder 28. The locking device 29 connects the rack 17 on one side in order to produce the rotational drive for the rounding segments 3, and is isolated from the guide frame 26 on the other side for the purpose of vertical adjustment upon disengagement of the rotational drive of the rounding segment 3.

Referring to FIG. 4, in order to prevent the rounding segment 3 from rotating during vertical adjustment, a brake shoe 31, which is controlled by a working cylinder 30, is located at the frame 16 and acts on the gearwheel 18.

Turning again to FIG. 1, the travel of the two rounding heads 4 and 5 in the vertical plane to produce the synchronous rotational movement of the rounding segments 3 on the one hand and to transfer the rounding segments 3 into preselectable, defined vertical positions on the other is effected by a working cylinder 32. In particular, a drive shaft 33, which is mounted in bearings 11 a at the machine frame 11, is connected by a lever 34 to the working cylinder 32. Guide connecting rods 35 and 36 are connected between the two supporting frames 16 of the rounding heads 4 and 5 and the drive shaft 33.

Format-dependent rounding displacements and different folded widths can be set under computer control via the positioning stroke of the rounding heads 4 and 5, which is controlled by the working cylinder 32, with the aid of a shaft encoder measuring system 37. The lifting movement of the book block 1 through the rounding segments 3, when the rotational or rolling movement is disconnected by working cylinder 28, adjustments may be made to obtain the desired folded width, according to the folded form, and any necessary format-dependent compensating stroke, e.g., into preselectable vertical positions to be executed following intermediate take-up by the studded chain conveyor 2.

Referring to FIGS. 1 and 3, the pressing force to be applied for back rounding via the rounding segments 3 to the sides of the book block 1 through transverse travel of the rounding heads 4 and 5 is provided by a working cylinder 38. The working cylinder 38 connects together the two carriages 7 and 8 moveable on the guides 9 and 10. The clamping force of the rounding segments 3 can be adjusted via a control valve 39 with pressure regulator 45 and sensor 39*a*. In order to achieve a synchronous movement, coupling rods 40 and 41 are located at the carriages 7 and 8. The coupling rods 40 and 41 are of the same length and in the form of a four-bar arrangement with link rollers 43 and 44 running in a linear guide 42 oriented centrally with respect to the studded chain conveyor 2. The mechanical positive coupling connected by the coupling rods 40 and 41, therefore provides central clamping of the rounding segments 3. The rounding segments 3 automatically adjust to the respective thickness of the book block 1 through controlling the clamping movement via an analogue pressure regulator 45.

While the present invention has been described in connection with what is presently considered to be the most practical and preferred embodiments, it is to be understood that the present invention is not limited to the disclosed embodiments. Rather, it is intended to cover all of the various modifications and equivalent arrangements included within the spirit and scope of the appended claims.

What is claimed is:

1. Device for back rounding book blocks in a bookbinding machine cooperating with a conveyer device for conveying the book blocks, comprising:

at least two rounding elements engaging a book block following release of the book block by the conveyer device, the rounding elements acting on both sides of the book block to provide a clamping force to the book block for back rounding of the book block; and a driving arrangement for driving the rounding elements in a lifting movement into preselectable, defined vertical positions and in a rotational movement, the driving arrangement comprising means for selectively separating the lifting movement from the rotational movement of the rounding elements.

2. The device of claim 1, wherein the driving arrangement comprises:

rounding heads in which the rounding elements are mounted;

vertical guides;

drive means for urging the rounding heads to travel in synchronism vertically along the vertical guides, and a gearwheel rack drive for causing the rotational movement of the rounding elements from the vertical movement initiated by the drive means;

wherein the rounding elements are uncoupleable from the drive means.

3. The device of claim 2, wherein the gearwheel rack drive comprises:

a selectively stationary rack which travels on a vertical guide, a locking device for selectively locking the stationary rack in a stationary position on the vertical guide whereupon movement of the gearwheel rack drive causes rotational movement of the rounding elements and when the locking device is unlocked rotational movement of the rounding elements is interrupted and the rack drives along the vertical guide.

4. The device according to claim 3 further comprising a braking means for preventing the rotational movement of the rounding elements when uncoupled from said driving arrangement.

5. The device of claim 3 further comprising a gearwheel drive for driving the rounding elements, the gearwheel drive being driven by the stationary rack and the gearwheel drive including a driving gear wheel and wherein the rounding elements have a rounding radius which corresponds to a pitch diameter of the driving gearwheel.

6. The device of claim 5, wherein the rounding elements comprise roller-shaped segments.

7. The device of claim 3 further comprising:

a working cylinder; and a common driving device connected to the working cylinder and the rounding elements;

wherein the working cylinder causes movement of the rounding elements in a vertical direction.

8. The device of claim 3, wherein the rounding elements comprise roller-shaped segments.

9. The device of claim 3, wherein the driving arrangement further comprises a working cylinder for providing the clamping force to the sides of the book blocks via the rounding elements connected to the rounding heads which are located on vertical guides in carriages and wherein the rounding heads can be displaced synchronously towards the center of a conveyor on horizontal guides, and the carriages are guided in a linear guide oriented towards the center of the conveyor of the book blocks.

10. The device of claim 9, further comprising:

a hydraulic cylinder which connects together the carriages;

coupling rods which are of the same length and are hinged to the carriages; and link rollers running in the linear guide;

wherein the hydraulic cylinder, coupling rods and link rollers cooperate such that the book blocks are clamped in a symmetrical and centered fashion.

11. The device of claim 10 wherein the coupling rods acting on the carriages comprise a four-bar arrangement.

12. The device of claim 11, further comprising a pressure regulating valve for adjusting the clamping force of the rounding elements.

13. The device of claim 10, further comprising a regulating device for adjustably controlling the hydraulic cylinder whereby the rounding elements are centrally aligned with the book block.

14. The device of claim 3, wherein the driving arrangement further comprises a working cylinder for providing the clamping force to the sides of the book blocks via the rounding elements connected to the rounding heads which are located on vertical guides in carriages and wherein the rounding heads can be displaced synchronously towards the center of a conveyor on horizontal guides, and the carriages are guided in a linear guide oriented towards the center of the conveyor of the book blocks.

15. The device of claim 14, further comprising:

a hydraulic cylinder which connects together the carriages;

coupling rods which are of the same length and are hinged to the carriages; and link rollers running in the linear guide;

wherein the hydraulic cylinder, coupling rods and link rollers cooperate such that the book blocks are clamped in a symmetrical and centered fashion.

16. The device of claim 15 wherein the coupling rods acting on the carriages comprise a four-bar arrangement.

17. The device of claim 16, further comprising a pressure regulating valve for adjusting the clamping force of the rounding elements.

18. The device of claim 15, further comprising a regulating device for adjustably controlling the hydraulic cylinder whereby the rounding elements are centrally aligned with the book block.

19. The device according to claim 2 further comprising a braking means for preventing the rotational movement of the rounding elements when uncoupled from said driving arrangement.

20. The device of claim 19 further comprising a gearwheel drive for driving the rounding elements, the gearwheel drive being driven by the stationary rack and the gearwheel drive including a driving gear wheel and wherein the rounding elements have a rounding radius which corresponds to a pitch diameter of the driving gearwheel.

21. The device of claim 19 further comprising:

a working cylinder; and a common driving device connected to the working cylinder and the rounding elements;

wherein the working cylinder causes movement of the rounding elements in a vertical direction.

22. The device of claim 2 further comprising:

a working cylinder; and a common driving device connected to the working cylinder and the rounding elements;

wherein the working cylinder causes movement of the rounding elements in a vertical direction.

23. The device of claim 22, wherein the rounding elements comprise roller-shaped segments.

24. The device of claim 2, wherein the rounding elements comprise roller-shaped segments.

25. The device of claim 2, wherein the driving arrangement further comprises a working cylinder for providing the clamping force to the sides of the book blocks via the rounding elements connected to the rounding heads which are located on vertical guides in carriages and wherein the rounding heads can be displaced synchronously towards the center of a conveyor on horizontal guides, and the carriages are guided in a linear guide oriented towards the center of the conveyor of the book blocks.

26. The device of claim 25, further comprising:

a hydraulic cylinder which connects together the carriages;

coupling rods which are of the same length and are hinged to the carriages; and link rollers running in the linear guide;

wherein the hydraulic cylinder, coupling rods and link rollers cooperate such that the book blocks are clamped in a symmetrical and centered fashion.

27. The device of claim 26 wherein the coupling rods acting on the carriages comprise a four-bar arrangement.

28. The device of claim 27, further comprising a pressure regulating valve for adjusting the clamping force of the rounding elements.

29. The device of claim 26, further comprising a regulating device for adjustably controlling the hydraulic cylinder whereby the rounding elements are centrally aligned with the book block.

30. The device of claim 1, wherein the driving arrangement comprises;

driving means for synchronously driving rounding heads supporting the rounding elements along vertical guides;

a gearwheel rack drive which causes rotational movement of the rounding elements from the vertical movement of the rounding heads;

a displacement measuring system; and a working cylinder for adjusting a rounding displacement of the rounding elements via a stroke of the working cylinder on the basis of the displacement measuring system.

31. The device of claim 30, wherein the rounding elements comprise roller-shaped segments.

32. The device of claim 30, wherein the driving arrangement further comprises another working cylinder for providing the clamping force to the sides of the book blocks via the rounding elements connected to the rounding heads which are located on vertical guides in carriages and wherein the rounding heads can be displaced synchronously towards the center of a conveyor on horizontal guides, and the carriages are guided in a linear guide oriented towards the center of the conveyor of the book blocks.

33. The device of claim 32, further comprising:

a hydraulic cylinder which connects together the carriages;

coupling rods which are of the same length and are hinged to the carriages; and link rollers running in the linear guide;

wherein the hydraulic cylinder, coupling rods and link rollers cooperate such that the book blocks are clamped in a symmetrical and centered fashion.

34. The device of claim 33 wherein the coupling rods acting on the carriages comprise a four-bar arrangement.

35. The device of claim 34, further comprising a pressure regulating valve for adjusting the clamping force of the rounding elements.

36. The device of claim 33, further comprising a regulating device for adjustably controlling the hydraulic cylinder whereby the rounding elements are centrally aligned with the book block.

37. The device of claim 30, wherein the folded width of the book blocks is adjusted via the positioning stroke on the basis of the measuring system.

38. The device of claim 37, wherein the rounding displacement and folded width is adjustable by a computer.

39. The device of claim 1, wherein the rounding elements comprise roller-shaped segments.

* * * * *